US005079922A

United States Patent [19]

Viscovich et al.

[11] Patent Number: 5,079,922

[45] Date of Patent: Jan. 14, 1992

[54] MOISTURE-SEPARATOR-REHEATER DRAIN COOLER SYSTEM

[75] Inventors: Paul W. Viscovich, Longwood; George J. Silvestri, Jr., Winter Park; Richard M. Stephani, Winter Springs; Homer G. Hargrove, Maitland, all of Fla.

[73] Assignee: Westinghouse Electric Corp., Pittsburgh, Pa.

[21] Appl. No.: 609,938

[22] Filed: Nov. 7, 1990

[51] Int. Cl.[5] ..... F01K 07/38; F01K 07/22

[52] U.S. Cl. ..... 60/678; 60/660

[58] Field of Search ..... 60/660, 667, 678, 679

*Primary Examiner*—Allen M. Ostrager

*Attorney, Agent, or Firm*—K. Bach

[57] ABSTRACT

A steam turbine system has a plurality of moisture-separator-reheaters (MSR) each connected via a respective drain line to a corresponding drain receiver. Each drain receiver includes a further drain line coupled through a flow control valve to a common line. The common line empties into a drain cooler connected at the highest pressure end of a series of feedwater reheaters. The drain cooler dumps through another flow control valve to one of the feedwater heaters. Each of the drain receivers includes a pressure sensor and liquid level sensor. A control processor monitors the pressure sensors and selects the drain receiver subjected to the lowest pressure. The processor then fully opens the valve associated with the selected drain receiver and thereafter regulates the liquid level in the others of the drain receivers by adjustment of their respective flow control valves in response to their respective level sensors. The liquid level in the selected drain receiver is adjusted to its preselected level by control of the flow control valve connected to the drain cooler. The pressure in the common drain line is regulated to the pressure at the lowest pressure drain receiver by adjustment of the control valves associated with the other drain receivers.

8 Claims, 3 Drawing Sheets

MOISTURE-SEPARATOR-REHEATER DRAIN COOLER SYSTEM

BACKGROUND OF THE INVENTION

1. Field of the Invention

This invention relates to steam turbines and, more particularly, to an apparatus and method for incorporating a drain cooler in a multiple drain receiver reheat system.

2. Description of the Prior Art

Virtually all nuclear steam turbine generators, operating under slightly wet or low superheated initial steam conditions, incorporate steam-to-steam reheat to improve thermal performance and reduce blade erosion. Rising fuel costs have led to the use of higher initial operating pressures and temperatures and additional reheat features, including an increase in the number of heaters that are employed in a turbine cycle. The higher pressures and temperatures have led to other design developments including provision for higher outlet water temperatures by utilizing superheat of the steam, and drain cooling sections in the heaters that subcool condensate.

In some prior applications of steam-to-steam reheater drains, drain fluid is discharged as a mixture of condensed steam and scavenging steam from a high pressure reheater in a moisture-separator-reheater (hereinafter MSR) to the highest pressure feedwater heater where the fluid is combined with condensed heater steam from a first turbine extraction point. ("Scavenging steam" refers to small amounts of dry steam bled from the main steam supply lines and directed through the tubes of the reheater bundle to prevent the condensate from subcooling and collecting, particularly in those tubes at the lower elevations of the bundle or the outermost U-shaped tubes of the bundle which are exposed to the lowest temperature incoming steam to be reheated. Condensate collection may result in subcooling and the associated sudden temperature change may damage piping when condensate is eventually blown from the piping by the pressure build-up. Steam-to-steam reheat designs usually employ approximately 2% of total reheater steam supply at rated load for scavenging steam to prevent moisture build-up in the reheater tubes.)

From the highest pressure feedwater heater, the condensed steam and other drain flows are then discharged or cascaded seriatim to lower and lower pressure feedwater heaters until at some point in the cycle, the flows become part of the main feedwater stream.

As previously disclosed in U.S. Pat. No. 4,825,657 assigned to Westinghouse Electric Corporation, the drains leaving the MSR high pressure reheater are considerably hotter than the feedwater leaving the highest pressure feedwater heater, as much as 55° C. (100° F.) at rated load, and in excess of 140° C. (250° F.) at 25% load. Accordingly, the drains must be throttled down to the feedwater pressure prior to heat exchange. This results in a loss in thermal efficiency.

One suggested method of minimizing this loss is to pump the high pressure reheater drain fluid into the outlet of the highest pressure feedwater heater. Major drawbacks of this method are: a) an additional pump is required; b) the difficulty of avoiding cavitation due either to insufficient net positive suction head in steady state conditions or to flashing during transients; and c) disposal of scavenging steam that is used to enhance the reheater tube bundle reliability.

The above-referenced U.S. Pat. No. 4,825,657 describes a method and apparatus for improving the thermal efficiency of steam-to-steam reheating systems within steam turbine generator systems by allowing the reheater drain fluid to be directly added to the feedwater stream without the need for additional pumping through use of a drain cooler. The high pressure reheater drain fluid passes through the drain cooler in heat exchange relationship with condensate from the discharge of the highest pressure feedwater heater. This avoids the loss of thermal efficiency resulting from throttling of the reheater drain pressure. Heat rate improvement is greater when the system is operated at less than 100% load. The disclosed system is set forth in the context of field retrofit application to single and multistage moisture-separator-reheaters. These existing systems include drain receivers with level controls. Fluid from high pressure reheater drains is collected in the drain receivers and then directed to a heat exchanger (drain cooler) in heat exchange relationship with condensate from a high pressure feedwater heater. The use of a drain cooler avoids loss of thermal efficiency from throttling of reheater drain pressure.

Conventional reheater drain systems customarily employ a pressure breakdown section between the MSR reheater drain connection and the feedwater heater receiving the drain fluid, and a level-controlled drain receiver to accept the condensed heating steam. There is a significant reliability problem with drain receivers, which frequently produce internal flooding in the drain tube bundle from the high pressure MSR. Such flooding has contributed to numerous damaged tube bundles, necessitating reduced load operation at impaired plant efficiency.

Further, because of the decrease in heater pressure at low loads, accompanied in many instances with an increase in reheater supply pressure, the percentage of scavenging steam increases with decreasing load. However, an increase in scavenging steam has been shown to have only a small affect on the heat rate of a cycle employing a drain cooler.

U.S. Pat. No. (55,161) discloses a method and apparatus for improving a steam-to-steam reheat system in a steam turbine employing a drain cooler. The utility of a drain cooler is enhanced by installing a condensate bypass line with a control valve to allow adjustment of the condensing capability of the drain cooler by optimizing the amount of scavenging steam in accordance with load conditions, thereby achieving a heat rate reduction. A steam turbine generator employs a steam-to-steam reheating system which utilizes a small component of scavenging steam to prevent moisture build-up in the bottom most tubes of a reheater bundle. The system has a high pressure moisture-separator-reheater with a reheater drain, and several feedwater heaters connected in series to heat feedwater of increasing pressure. Each of the feedwater heaters has an inlet and an outlet for feedwater. Heating of feedwater is accomplished in a drain cooler which receives fluid from the reheater drain and passes it in heat exchange relationship with outlet feedwater prior to feeding the reheater drain fluid to the highest pressure feedwater heater. The system controls the amount of scavenging steam and the fluid level at the drain cooler heat exchanger to control the heat capacity of the drain cooler and eliminate the need for a drain receiver level control.

In most existing utility power plant installations, the reheat system employs a plurality of moisture-separator-reheaters (MSR). The separate MSR's or even the separated drains from a common MSR may discharge at different pressures. Each drain is typically directed to a corresponding drain receiver and each drain receiver includes a control valve for maintaining a preselected liquid level in the respective drain receiver. The liquid acts as a seal between the higher pressure steam within the MSR tube bundle and the lower pressure feedwater heater line.

It is desirable to combine the drain lines from each drain receiver into a manifold so that a single line connects to a drain cooler. However, the normal pressure variation between drain receivers may be from 703 $k/m^2$ to 17577 $k/m^2$ (one to twenty-five pounds per square inch (PSI)). This difference in pressure could force condensate liquid from one of the lower pressure drain receivers back into the associated MSR and result in internal flooding. Such flooding is believed to be the cause of various turbine performance and reliability problems.

SUMMARY OF THE INVENTION

Among the several objects of the present invention may be noted the provision of a method and apparatus which overcomes the above and other disadvantages associated with combining of different pressure drain lines; the provision of a method and apparatus for combining different pressure drains into a common line; and a method and apparatus for controlling liquid levels in multiple drain receivers coupled to a common drain line.

In an illustrative form, the present invention is implemented in a steam turbine system having a plurality of moisture-separator-reheaters (MSR) each connected via a respective drain line to a corresponding drain receiver. Each drain receiver includes a further drain line coupled through a flow control valve to a common line. The common line empties into a drain cooler connected at the highest pressure end of a series of feedwater reheaters. The drain cooler dumps through another flow control valve to one of the feedwater heaters. Each of the drain receivers includes a pressure sensor and liquid level sensor.

In operation, a control processor monitors the pressure sensors and selects the drain receiver subjected to the lowest pressure. The processor then fully opens the valve associated with the selected drain receiver and thereafter regulates the liquid level in the others of the drain receivers by adjustment of their respective flow control valves in response to their respective level sensors. The liquid level in the selected drain receiver is adjusted to its preselected level by control of the flow control valve connected to the drain cooler. In this manner, the pressure in the common drain line is regulated to the pressure at the lowest pressure drain receiver by adjustment of the control valves associated with the other drain receivers. During transient operation, the processor will automatically detect any changes in pressure and select as a reference drain receiver the one having the lowest pressure, thereafter opening fully the flow control valve associated with such reference drain receiver and adjusting the others of the valves to maintain a preselected liquid level in their respective drain receivers.

BRIEF DESCRIPTION OF THE DRAWINGS

For a better understanding of the present invention, reference may be had to the following detailed description taken in conjunction with the accompanying drawings in which.

DETAILED DESCRIPTION OF THE INVENTION

Figure 1:
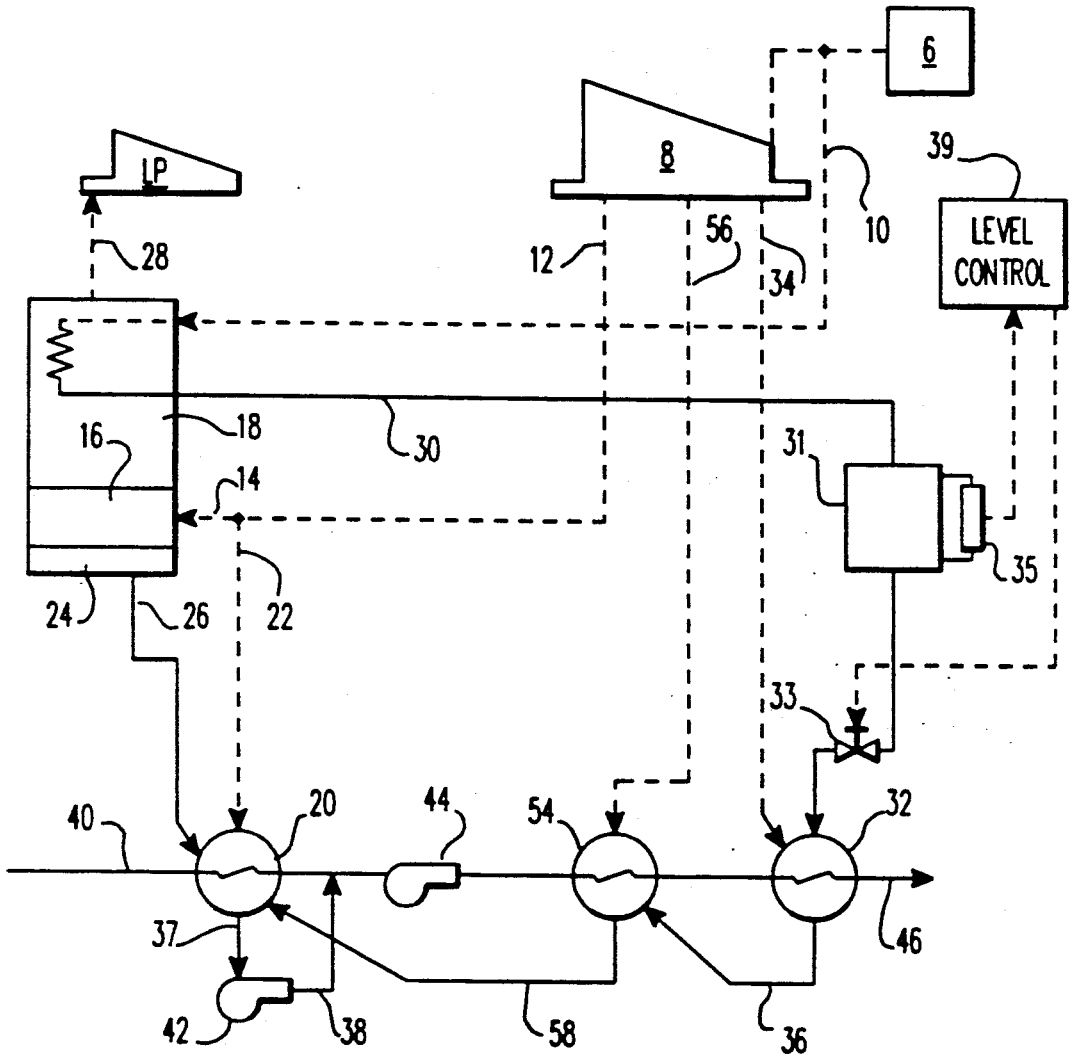
FIG. 1 PRIOR ART
FIG. 1 is a schematic diagram illustrating a portion of a conventional prior art single stage reheater plant.

FIG. 1 illustrates a typical installation of a single stage steam-to-steam reheat system of the prior art. A steam/water mixture or low superheated steam is taken from the steam exiting the steam generator 6 prior to injection into a high pressure turbine element 8. High pressure exhaust steam 12 from the high pressure turbine element 8 is split such that the major steam portion 14 is fed to a moisture separator 16 within a steam reheater 18. The combined moisture separator and reheater is referred to as a moisture-separator-reheater or MSR. The remainder of the high pressure exhaust steam 12 is fed to a feedwater heater 20 as indicated by line 22. The portion 14 of the high pressure exhaust steam 12 that is fed to the moisture separator 16 is substantially separated such that the majority of the liquid in steam portion 14 collects in a drain tank 24 and is fed therefrom to feedwater heater 20 via piping 26. The steam contained in the separated steam portion 14 is reheated in an upper section of the steam reheater 18 by passing in heat exchange relationship with a steam/water mixture flowing in piping 10. The reheated steam 28 is then directed to a lower pressure turbine element LP. The reheater bundle drains 30, containing predominately condensed liquid of the steam/water mixture from piping 10, is typically led to level-controlled drain receiver 31. In some existing units, a small diameter line is used to control scavenging steam flow in place of the pressure breakdown device or drain receiver 31. From drain receiver 31, the stream is fed to the highest pressure feedwater heater 32. The heating side of this feedwater heater 32 is supplemented with partially expanded extraction steam 34 from a high pressure turbine element. The exit drain fluid from heater 32 is typically cascaded to the next lower pressure feedwater heater 54 via piping 36. The exit drain fluid from heater 54 is then cascaded to the next lower pressure feedwater heater 20 via piping 58. Often, fluid drained from such a lower pressure feedwater heater 20 via line 37 is pumped directly into the feedwater lines 40 via lines 38 using a small pump 42. Also, the feedwater in lines 40 is typically pumped via pump 44 to a high pressure prior to entering feedwater heater 54 and the final feedwater heater 32, thereby ending up as a high pressure, high temperature feedwater in line 46.

Figure 2:
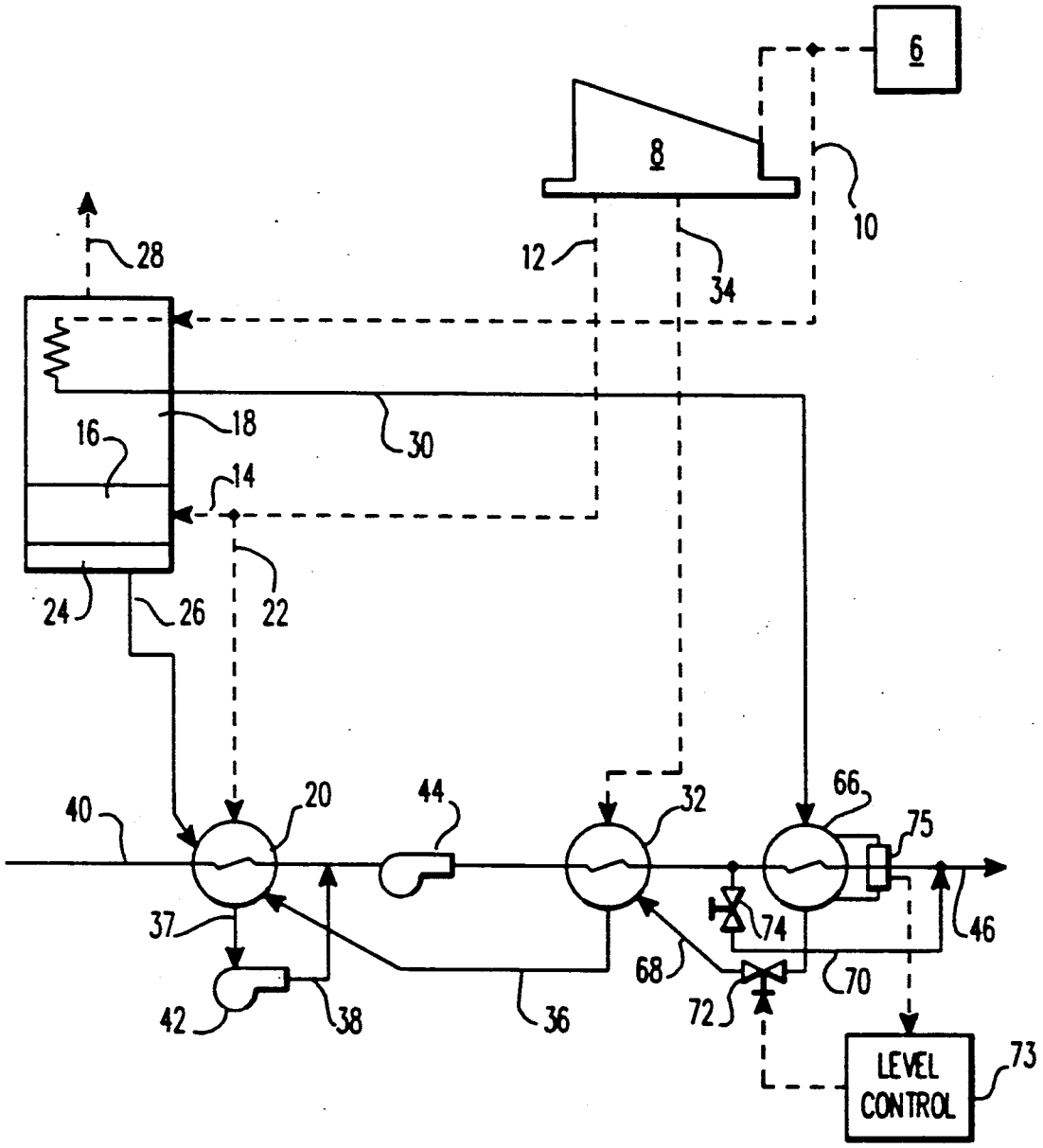
FIG. 2 PRIOR ART
FIG. 2 is a schematic diagram illustrating a portion of a single stage reheater plant incorporating the apparatus and method of the present invention.

FIG. 2 illustrates one form of a system for coupling the high pressure MSR fluid in line 30 into the feedwater reheat system without throttling the pressure in the line. The major elements of the single stage reheating system as described above remain much the same. The modifications include removing the level-controlled drain receiver 31 together with its control valve 33 and level sensor 35. A level control unit 37 responds to signals from liquid level sensor 35 to adjust valve 33 to maintain the liquid level in drain receiver 31 at a preselected level. In essence, such liquid level control throttles the drain flow to compensate for pressure differences between MSR 18 and feedwater heater 32. Drain cooler 66, as disclosed in U.S. Pat. No. 4,825,657, is installed to receive the steam condensate mixture from the reheater bundle drains 30 without pressure throttling. Drain fluid from the drain cooler 66 is cascaded via piping 68 to the highest pressure feedwater heater 32. A condensate bypass line 70 routes the feedwater in line 40 exiting from feedwater heater 32 around drain cooler 66 to enter the main feedwater line 46. Bypass line 70 is equipped with a valve 74 to regulate the flow in bypass line 70. The bypass line 70 and valve 74 allow independent control of the scavenging steam to meet the need for an increase in scavenging steam when required by reheater operation. Furthermore, fluid level control is provided by valve 72 connected in drain line 68 between drain cooler 66 and feedwater heater 32, which valve 72 is responsive to signals from level control 73 in response to level sensor 75. By controlling fluid level with valve 72, the heat capacity of the drain cooler is controlled.

Figure 3:
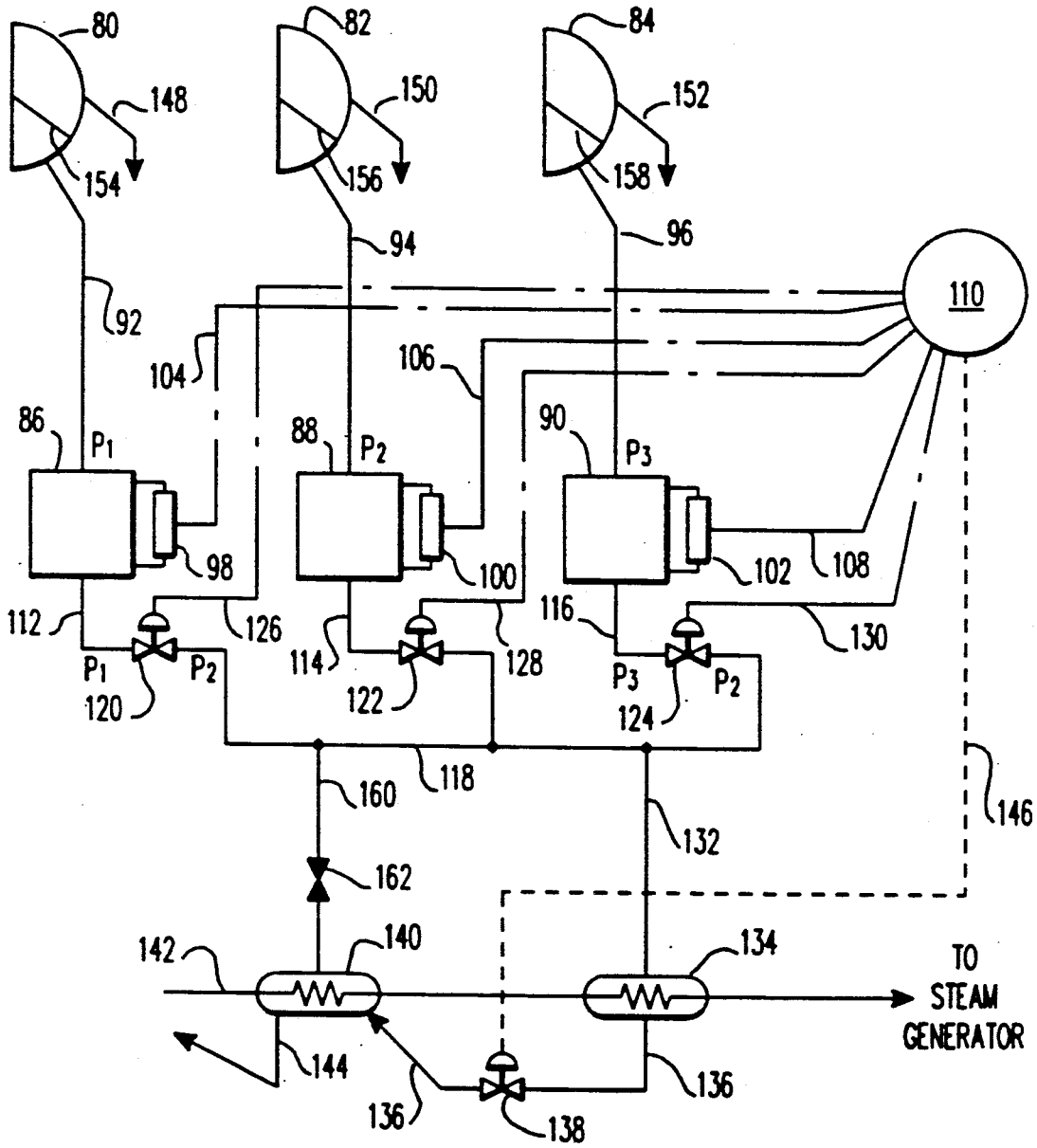
FIG. 3 is a schematic diagram illustrating a portion of a two-stage reheater plant incorporating the apparatus of the present invention.

While the system of FIG. 2 is effective in some applications, other applications utilize multiple MSR's each of which drain at different pressures. If each of these MSR's are coupled to a common drain line leading to a drain cooler, the common drain line will be charged to the highest pressure and can force drain fluid in a reverse direction into the lower pressure MSR's resulting in reduced efficiency and reliability. Referring to FIG. 3, there is illustrated one form of system utilizing the above described drain cooler concept, which system accommodates multiple MSR's at different drain pressures. While only three MSR's are illustrated, any number may be coupled into the system. For discussion purposes, it is assumed that MSR 80 discharges at a drain pressure P1, MSR 82 discharges at a drain pressure P2, MSR 84 discharges at a drain pressure P3, and that P1 and P3 are greater than P2. Each MSR 80, 82, and 84 discharges to a corresponding one of the drain receivers 86, 88, and 90 via respective drain lines 92, 94, and 96. Each drain receiver 86, 88, and 90 has coupled to it a respective sensor 98, 100, and 102, which sensors include both a level sensor and a pressure sensor. The sensors 98, 100, and 102 provide signals via respective lines 104, 106, and 108 to a control processor 110. The sensor signals represent the pressure P1, P2, and P3 and the liquid level in each of the drain receivers 86, 88, and 90.

Each of the drain receivers 86, 88 and 90 incorporates a corresponding drain line 112, 114, and 116 discharging into a common drain line or manifold 118. Each drain line 112, 114, and 116 includes a respective flow control valve 120, 122, and 124. The flow control valves 120, 122, and 124 are remotely controllable valves of a type well known in the art and may be hydraulic, pneumatic, or electrically controlled. The control processor 110 includes appropriate driver devices (not shown) for controlling the valves 120, 122, and 124 as indicated by the control lines 126, 128, and 130.

The manifold 118 discharges fluid via outlet drain line 132 into a high pressure drain cooler 134, which drain cooler 134 corresponds to drain cooler 66 in FIG. 2. A drain line 136 and series flow control valve 138 (corresponding to drain line 68 and valve 72 of FIG. 2) provide a fluid discharge path from drain cooler 134 to a highest pressure feedwater heater 140 in a cascaded sequence of feedwater heaters arranged substantially as shown in FIG. 2. Feedwater in the feedwater line 142 passing through the drain cooler 134 and feedwater heater 140 is heated by the discharge fluid from the MSR's 80, 82, and 84 supplied via line 132. Heater 140 also includes a discharge line 144 as does each additional feedwater heater in the sequence. The valve 138 is similar to other flow control valves, such a valve 120, and is controlled by controller 110 as indicated by control line 146.

In the operation of the system of FIG. 3, the controller 110 monitors the pressure sensor signals from each of the sensors 98, 100, and 102 and determines which of the pressures P1, P2, or P3 is the lowest. The drain receiver associated with the lowest pressure is selected as the controlling unit. Assuming that P2 is the lowest discharge pressure, valve 122 associated with drain receiver 88 is fully opened. Valve 138 is then controlled in a manner to regulate the liquid level in drain receiver 88 to a preselected level in response to signals via line 106 from level sensor 100. The liquid level in receiver 88 is established by turbine design as a function of the optimum level of fluid to accomplish drainage and avoid steam bypass.

Pressure from MSR's 80 and 84 are matched to the pressure in manifold 118, established by the drain receiver 88, by adjusting the flow control valves 120 and 124. Each of the valves 120, 124 are individually controlled in response to their respective associated level sensors 98 and 102. Applicants have found that regulating the liquid level in the drain receiver 86 and 90 is effective to balance the pressure in manifold 118 and prevent the higher pressures from these units overwhelming the lower pressure of receiver 88.

FIG. 3 also indicates second drain lines 148, 150, and 152 for discharging fluid from each of the MSR's 80, 82, and 84, respectively. These second drain lines discharge a mixture of steam and condensate that is typically at a lower pressure than the fluid discharge from the first drain lines 92, 94, and 96 of the respective MSR's. Within each MSR 80, 82, and 84 there exists a partition plate 154, 156, and 158, respectively. Each partition plate separates the upper portion of the vent discharge chamber (the chamber covering an end of the reheater tube bundles within the MSR) from the lower portion of the chamber. The drain lines 92, 94, and 96 are typically discharging condensed steam after passage through a first section of tube bundles. Uncondensed steam enters a second section of the tube bundles and discharges through drain lines 148, 150, and 152. Since the discharge is downstream of the first section, it is at a lower pressure even though it contains some uncondensed steam. In such systems, it is necessary to utilize additional drain receivers (not shown) coupled to each of the other drain lines 148, 150, and 152 in order to discharge them to the manifold 118. The arrangement and control of such additional drain receivers is the same as for drain receivers 86, 88, and 90.

In some instances, it may be desirable to discharge the manifold 118 into the highest pressure feedwater heater 134. For example, rework of the drain cooler without shutting down the turbine may be desired. Accordingly, a drain line 160 with a normally closed valve 162 is coupled between the manifold 118 and heater 140. More complete isolation of drain cooler 134 may also require a valve (not shown) in line 132.

While the principles of the invention have now been made clear in an illustrative embodiment, it will become apparent to those skilled in the art that many modifications of the structures, arrangements, and components presented in the above illustrations may be made in the practice of the invention in order to develop alternate embodiments suitable to specific operating requirements without departing from the spirit and scope of the invention as set forth in the appended claims.

What is claimed is:

1. A method for combining multiple drain receiver output lines in a steam turbine system, each drain receiver including a control sensor for providing signals representative of pressure and liquid level in a respective drain receiver, a flow control valve connected in each of the output lines of the respective drain receivers, each of the output lines being coupled to a common drain line for discharging liquid from the drain receivers to a drain cooler, the drain cooler including an outlet control valve for controlling the flow of liquid therethrough from the drain receivers, and control means coupled to the level sensors and control valves for controlling the valves at least in response to the sensors, the method comprising the steps of:

sensing pressure at each of the drain receivers and selecting a one having a lowest discharge pressure;

opening fully the flow control valve at the selected drain receiver having the lowest discharge pressure;

adjusting the outlet control valve at the drain cooler to regulate the liquid level in the selected drain receiver to a preselected level; and controlling others of the flow control valves to regulate liquid levels in their respective drain receivers to preselected levels.

2. The method of claim 1 wherein the drain cooler is connected in cascade with a sequence of feedwater heaters and the outlet control valve is connected in a discharge line between the drain cooler and the highest pressure one of the feedwater heaters, the step of adjusting the outlet control valve including the step of regulating discharge fluid flow from the drain cooler to the highest pressure one of the feedwater heaters.

3. The method of claim 2 and including substantially continuous monitoring of the sensors for determining changes in the one of the drain receivers having the lowest pressure and repeating the steps of opening, adjusting, and controlling in response to any determined changes.

4. In a steam turbine employing steam-to-steam reheating system having a plurality of high pressure moisture-separator-reheaters (MSR) each having a reheater drain, a plurality of feedwater heaters connected in series to heat feedwater of increasing pressure, each of said feedwater heaters having an inlet and an outlet for feedwater, and a heat exchanger for receiving fluid from said reheater drains and passing it in heat exchange relationship with feedwater, a system for combining drain fluid from the plurality of MSR's comprising:

a plurality of drain receivers, each of the drain receivers being connected to a corresponding one of the drains of a respective one of the MSR's;

a manifold and a plurality of drain lines connected thereto, each of the drain lines extending from a respective one of the drain receivers to the manifold and each drain line including a flow control valve for regulating fluid flow therethrough;

a manifold discharge line connected between the manifold and the heat exchanger for coupling discharge fluid thereto;

an outlet drain line connected between the heat exchanger and at least one of the feedwater heaters for passing the discharge fluid, the outlet drain line including another flow control valve; and means for controlling the flow control valves associated with the drain receivers and the another flow control valve associated with the manifold pressure to the pressure of the lowest pressure drain receiver.

5. The system of claim 4 and including sensors coupled to each to the drain receiver for providing signals representative of pressure and liquid level in each respective drain receiver, said controlling means being responsive to the sensors for operating the flow control valves.

6. The system of claim 5 wherein said controlling means is responsive to the one of the drain receivers having the lowest pressure for fully opening the flow control valve coupled thereto and for regulating the liquid level in the lowest pressure drain receiver by adjustment of the another flow control valve coupled to the heat exchanger.

7. The system of claim 6 and including a second drain line connected between the manifold and at least one of the feedwater heaters, a valve being coupled in the second drain line for selectively bypassing fluid around the heat exchanger.

8. The system of claim 6 wherein the at least one feedwater heater comprises the highest pressure feedwater heater.

* * * * *